US006526957B1

(12) United States Patent
Leven

(10) Patent No.: US 6,526,957 B1
(45) Date of Patent: Mar. 4, 2003

(54) COUPLER FOR MOUNTING A VIBRATION DAMPER TO AN ARCHERY BOW

(75) Inventor: William L. Leven, Canoga Park, CA (US)

(73) Assignee: Leven Industries, Canoga Park, CA (US)

( * ) Notice: Subject to any disclaimer, the term of this patent is extended or adjusted under 35 U.S.C. 154(b) by 0 days.

(21) Appl. No.: 09/975,616

(22) Filed: Oct. 10, 2001

(51) Int. Cl.[7] ..... F41B 5/20
(52) U.S. Cl. ..... 124/89
(58) Field of Search ..... 124/86, 88, 89

(56) References Cited

U.S. PATENT DOCUMENTS 3,412,725 A * 11/1968 Hoyt
5,513,622 A * 5/1996 Musacchia ..... 124/89
5,520,164 A * 5/1996 Huddleston ..... 124/86
5,558,078 A * 9/1996 Dunlap ..... 124/89

* cited by examiner

*Primary Examiner*—John A. Ricci
(74) *Attorney, Agent, or Firm*—Koda & Androlia

(57) ABSTRACT

A coupler for mounting a vibration damper to a limb of an archery bow, including a solid body having an attachment groove provided in a bottom portion of the body, which has a cross sectional shape for engaging with a projecting portion of a limb retainer, and a coupling hole provided in the top portion of the solid body to which the vibration damper is attached.

8 Claims, 4 Drawing Sheets

COUPLER FOR MOUNTING A VIBRATION DAMPER TO AN ARCHERY BOW

BACKGROUND OF THE INVENTION

1. Field of the Invention

The present invention relates to coupler for mounting vibration dampers to an archery bow and particularly to mounting vibration dampers to limbs of an archery bow.

2. Prior Art

It is inherent in the operation of an archery bow that when the arrow is launched from the bow, a substantial amount of vibration is generated. This is apparent in both traditional bows such as recurves and in compound bows, though it is more pronounced in compound bows since the amount of energy transferred is greater.

This vibration generated when an arrow is launched from the bow is undesirable for several reasons. Firstly, the vibration gives a strange feeling to the holder of the bow when the arrow is launched. Secondly and more importantly, the vibration has a deleterious effect upon the arrow flight.

Since a significant portion of this vibration is generated by the action of the limbs of the archery bow, means have been developed which mount onto the limbs themselves which absorb or reduce the amount of vibration. However, these means for absorbing the vibration from the limbs have certain disadvantages. In particular, such means are attached to the limbs by an adhesive. This adhesive is subject to failure with the result that the vibration absorbing means will be thrown off of the limb. If this should occur, this has a very deleterious effect upon the performance of the bow and may result in a broken limb. Still further, the chances of this occurring increases with limb speed. Accordingly, with the high performance bows with more and more limb and arrow speed, it is more likely that such vibration absorbing means will fail.

SUMMARY OF THE INVENTION

Accordingly, it is a general object of the present invention to provide a means for overcoming the disadvantages of the prior art.

In particular, it is an object of the present invention to provide a coupler which easily and economically allows for a strong mechanical connection to be made between the vibration damper and the limb of the archery bow.

In keeping with the principles of the present invention, the objects are accomplished by providing a unique coupler for mounting the vibration damper to the limbs of the archery bow. This coupler generally comprises a body having two sides, a means for mounting the body to the limb of the archery bow and a means for coupling the vibration damper to the body provided on the other side of the body. Typically the means for mounting the body to the limb would comprise a slot provided in the body which has a cross-sectional shape approximating the cross-sectional shape of the part of the bow which retains limb on the riser of the bow. The means for coupling the vibration damper to the body would typically comprise a threaded hole into which the vibration damper can be screwed into. Still further and for the purposes of stability of the limbs, it is preferable that the body be conical in shape with the widest portion of the conical shape engaging the limb.

BRIEF DESCRIPTION OF THE DRAWINGS

The above-mentioned features and objects of the present invention will become more apparent with reference to the following description taken together with the accompanying drawings wherein like reference numerals denote like elements and in which.

DETAILED DESCRIPTION OF THE INVENTION

Figure 1:
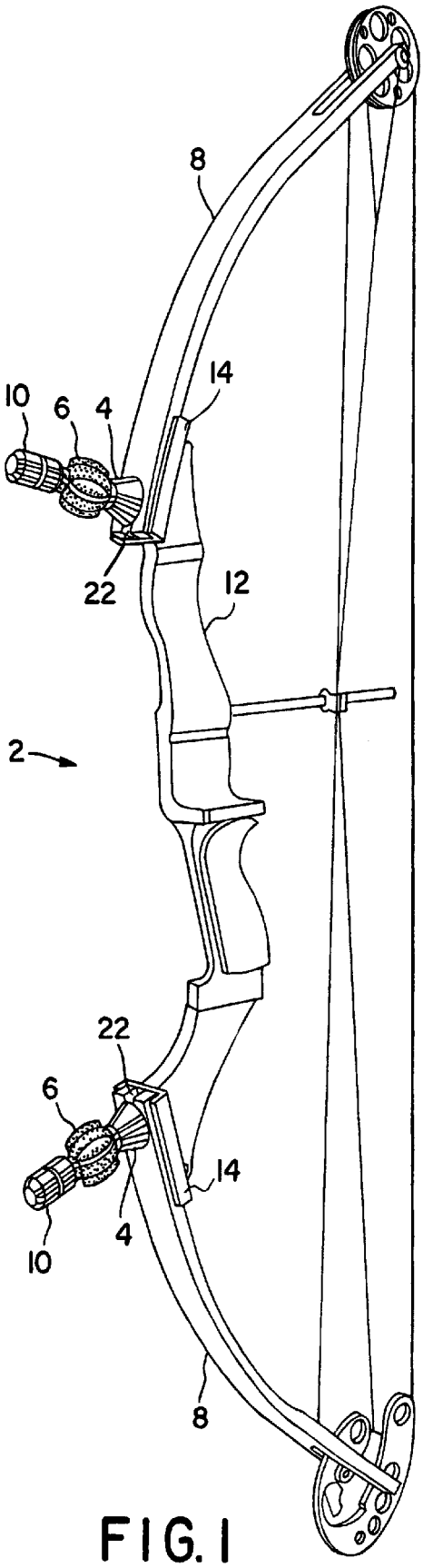
FIG. 1 is a perspective view of a compound archery bow utilizing the couplers of the present invention to mount vibration dampers to the limbs.
Figure 2:
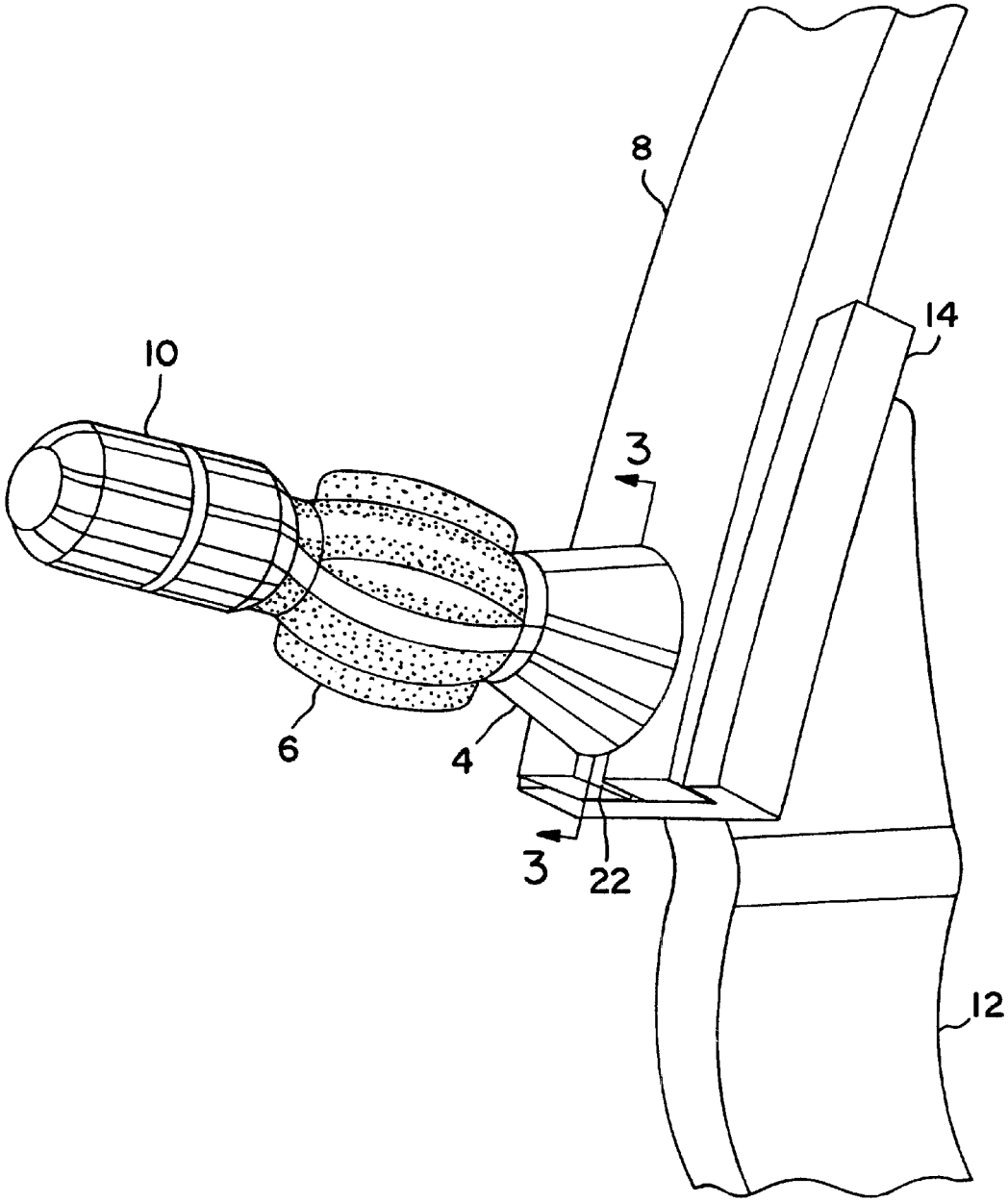
FIG. 2 is an enlarged view of a portion of FIG. 1 showing the attachment of the coupler to the limb and a vibration damper provided on the coupler.

Referring to FIGS. 1 and 2, shown therein, particularly in FIG. 1, is a compound archery bow 2 having couplers 4 in accordance with the teachings of the present invention for coupling vibration dampers 6 to the limbs 8 of the compound bow 2. The vibration damping means 6 can be further provided with weights 10 for not only assisting in the absorption of the vibration but also for setting the balance of the bow 2. The limbs 8 are further connected to the riser portion 12 of the compound bow 2 at the limb pockets 14.

Figure 3:
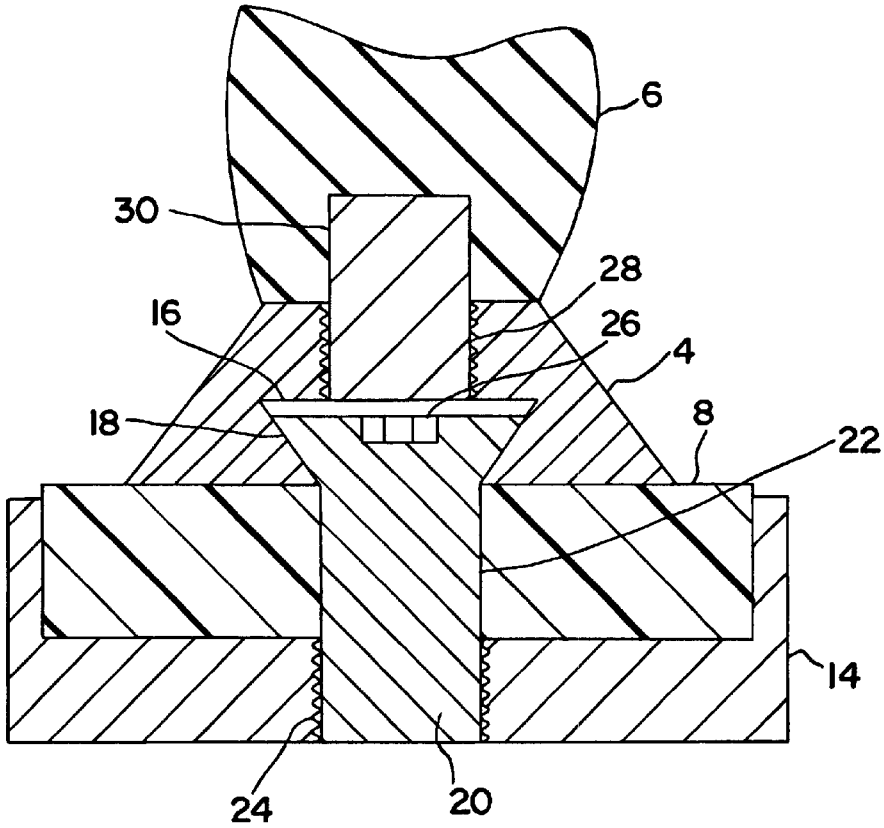
FIG. 3 is a cross-sectional view along the line 3—3 in FIG. 2 showing the construction of a first embodiment of the present invention.
Figure 4:
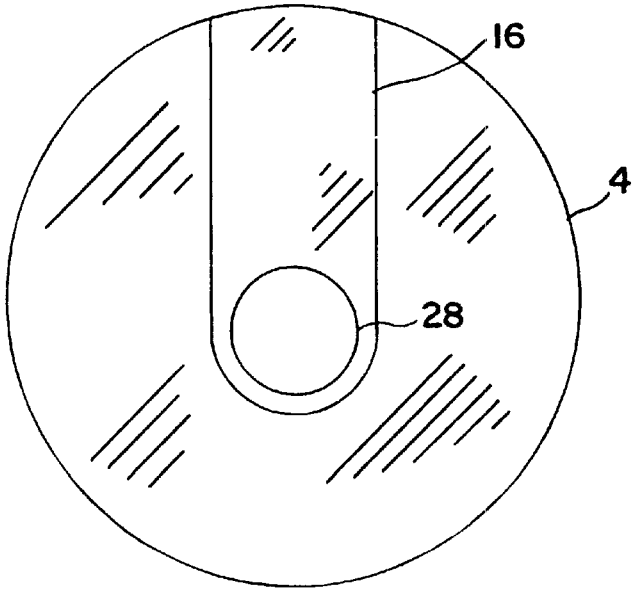
FIG. 4 is a bottom view of the coupler of FIG. 3.

Referring now to FIGS. 3 and 4, FIG. 3 shows the first embodiment of a coupler in accordance with the teachings of the present invention in cross-section and further illustrates how the coupler 4 connects the vibration damper 6 to the limb 8. As seen in FIG. 3, the coupler 4 is provided with a conical shaped groove 16. This conical shape groove 16 substantially extends across to the central axis of the coupler 4 as is shown in FIG. 4. The conical cross-section of the groove 16 is a shape which approximates the cross-sectional shape of the head portion 18 of the limb retaining bolt 20.

As can be clearly seen in FIG. 3, the limb retaining bolt 20 extends through a hole or slot 22 provided in the limb 8 and is threaded into a threaded hole 24 provided in the limb pocket 14 of the riser 12.

In use, the limb retaining bolt 20 is unscrewed to expose a sufficient amount of the head portion 18 so that the conical slot 16 can slide over and under the head 18 of the limb retaining bolt 20. A driving tool such as an alien wrench can then be engaged with the hexagonal shaped adjustment hole 26 provided in the top portion of the head 18 of the limb retaining bolt 20 by inserting the tool through the threaded hole 28 provided in the coupler 4. This allen wrench is inserted through the hole 28 before the vibration damper 6 is connected thereto. By means of the alien wrench the limb retaining bolt 20 is tightened until the limb 8 is securely attached to the limb pocket 14 and the draw weight of the bow 2 is set to the desired amount.

A vibration damper 6 is then connected to the coupler 4. This connection is accomplished by means of a threaded shaft 30 which is molded into the vibration damper 6 which itself is made from a vibration absorbing material such as rubber. A typical example of a vibration damper 6 is a DOINKER made by Leven Industries.

Accordingly, utilizing the coupler 4, the vibration damper 6 can be reliably mechanically connected to the limb 8 of the bow 2 and the chances of the vibration damper 6 becoming disconnected from the limbs 8 is drastically reduced and is very little if properly maintained.

Figure 5A:
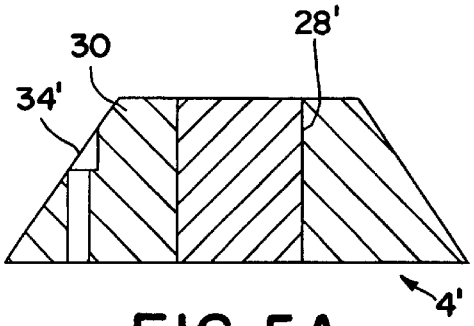
FIGS. 5A, 5B and 5C are, respectively, side cross-sectional views and a bottom view of a second embodiment of the coupler in accordance with the teachings of the present invention.
Figure 5C:
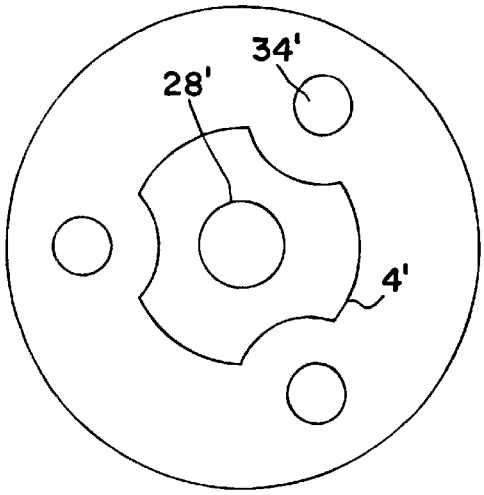
Figure 5B:
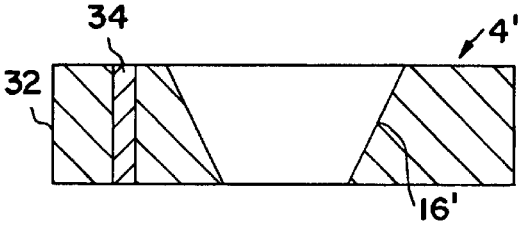

Referring to FIGS. 5A, 5B and 5C, show therein are cross-sectional views and a bottom view of a second embodiment of a coupler 4' in accordance with the teachings of the present invention. This second embodiment of the coupler 4' of the present invention is provided in two portions 30 and 32 instead of the single part of FIG. 3. The lower portion 32 is provided with a groove 16' which is substantially the same in cross-section and shape and function as the groove 16 of the coupler 4 of the first embodiment. The lower portion 32 is further provided with three threaded holes 34 which are spaced at equal intervals around the lower portion 2. It would be equally feasible to provide four holes except that the utilization of four holes will increase the cost and complexity without increasing the functionality and reliability of the coupler. The upper portion 30 is provided with a threaded hole 28' which is substantially the same as the threaded hole 28 provided in the coupler 4 of FIG. 3 and the first embodiment. This threaded hole 28' is for the attachment of the vibration damper 6. The upper portion 30 is further provided with three unthreaded holes 34' which correspond to the threaded holes 34 provided in the lower portion 32.

In use, the lower portion 32 is inserted onto the head portion 18 of the limb retaining bolt 20 in substantially the same way as the first embodiment. The limb retaining bolt 20 is then tightened to securely hold the bottom portion 32 of the coupler 4' to the limb 8 and the limb pocket 14 of the riser 12. After the lower portion 32 is securely fastened to the limb 8 by means of the limb retaining bolt 20, the upper portion 34' is connected to the lower portion 32 by means of screws (not shown) which are inserted through the holes 34' of the upper portion 30 and screwed into the threaded holes 34 in the lower portion 32. In a similar manner as the first embodiment, the vibration damper 6 is screwed into the threaded hole 28' by means of the threaded shaft 30 which is molded into the vibration damper 6.

Figure 6A:
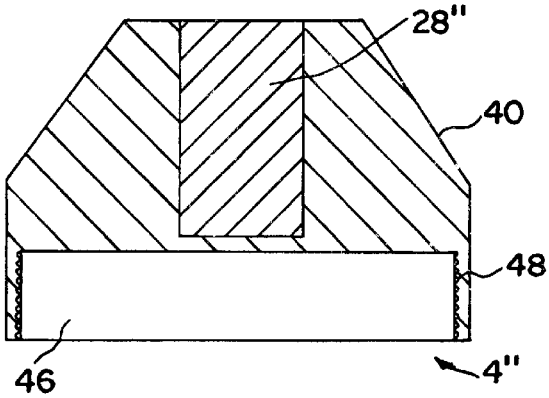
FIGS. 6A and 6B are cross-sectional views of a third embodiment of a coupler in accordance with the teachings of the present invention.
Figure 6B:
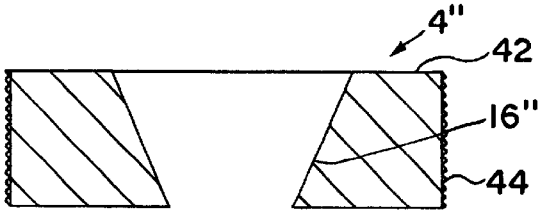

Referring to FIGS. 6A and 6B, shown therein is a cross-section of a third embodiment of a coupler 4" in accordance with the teachings of the present invention. Similarly to the second embodiment, this third embodiment is provided in upper and lower portions 40 and 42. The lower portion 42 is provided with a groove 16" which is substantially the same in cross-section and shape and function as the groove 18 provided in the coupler 4 of the first embodiment. The lower portion 42 is made in a cylindrical shape and the circumferential surface is provided with an outer threaded portion 44. The upper portion 40 is provided with a hole 28" which is substantially the same as the hole 28 provided in a coupler 4 of the first embodiment. The lower surface of the upper portion 40 is further provided with a cylindrically shaped recess 46. The cylindrical shape recess 46 is substantially the same in diameter and shape as the cylindrical shape bottom portion 42 and is further provided with an interior thread 48. In practice, it would also be possible to reverse the placement of the threads 44 and 48 on the upper and lower portions 40 and 42.

In use, the groove 16" of the lower portion 42 is inserted onto the head 18 of the limb retaining bolt 20 in substantially the same way as in the first embodiment. The limb retaining bolt 20 is then tightened to securely fasten the bottom portion 42 of the coupler 4" to the limb 8 and limb pocket 14 of the riser 12 of the compound bow 2. The inner threads 48 of the upper portion 40 are then screwed onto the outer threads 44 of the lower portion 42 and the upper portion 40 is tightened onto the lower portion 42. The vibration damper 6 is connected to the upper portion 40 of the coupler 4" by screwing the threaded shaft 30 into the threaded hole 28".

It should be apparent to those skilled in the art that each one of the first, second and third embodiments of the present invention functions in substantially the same way once it is installed on the limb 8 of the bow 2 and provides a reliable and stable connection to the limbs 8 of an archery bow 2. Still further, it should be apparent to those skilled in the art that the shape of the couplers in the first, second and third embodiments can be almost any solid shape such as a cone, a cube or a cylinder though a truncated conical shape is preferred. Also, while the size of the couplers of the first, second and third embodiments can be any size which is compatible with the size of the limbs 8 of the bow 2, typically the couplers are approximately 1.25 inches in diameter at the base, 0.75 inches in height and 0.75 inches across the top of the truncated conical shape. Still further, the threaded hole 28 is typically a $\frac{5}{16}$×24. Also, the coupler of the first, second and third embodiments can be made from any material which is strong enough to resist the stresses and strains of the bow 2 and could be made from a metal such as aluminum or a very hard and strong plastic such as nylon or bakelite.

It should be apparent to those skilled in the art that the above-described embodiments are merely illustrative of a few of the embodiments which could be created without departing from the spirit and scope of the present invention.

I claim:

1. A coupler for mounting dampening means to a limb of an archery bow, said coupler comprising:

a body having two sides;

a means for mounting the body to a limb retaining means provided in one side of said body; and a means for coupling a dampening means to said body provided on an other of said two sides.

2. The coupler according to claim 1, wherein said limb retaining means comprises a bolt and said means for mounting comprises a partial slot in said body having a cross-sectional shape substantially equal to a cross-sectional shape of a head of said bolt.

3. The coupler according to claim 2, wherein said means for coupling a damping means to said body comprises a threaded hole.

4. The coupler according to claim 3, wherein a diameter of said hole is large enough to allow said bolt to be operated therethrough.

5. The coupler according to claim 3, wherein said coupler is a truncated cone in shape.

6. The coupler according to claim 1, wherein said body is divided into two separable portions with said means for mounting provided in one portion and said means for coupling provided in said other portion.

7. The coupler according to claim 6, wherein said two separable portions are coupled together by thread means.

8. The coupler according to claim 6, wherein said two separable portions are coupled together by screw means.

* * * * *